United States Patent [19]

Gardner

[11] 4,333,783

[45] Jun. 8, 1982

[54] PIPE COATING APPARATUS

[76] Inventor: David L. Gardner, Rte. 23, Box 64, Conroe, Tex. 77303

[21] Appl. No.: 180,379

[22] Filed: Aug. 22, 1980

[51] Int. Cl.[3] ..... B65H 81/00

[52] U.S. Cl. ..... 156/187; 156/188; 156/195; 156/429; 156/446

[58] Field of Search ..... 156/187, 188, 195, 425, 156/428–429, 446; 118/232

[56] References Cited

U.S. PATENT DOCUMENTS

| | | | |
|---|---|---|---|
| 3,740,291 | 6/1973 | Mallard | 156/187 X |
| 4,006,049 | 2/1977 | Gardner | 156/425 X |
| 4,058,428 | 11/1977 | Case et al. | 156/188 X |

*Primary Examiner*—David A. Simmons
*Attorney, Agent, or Firm*—Gunn, Lee & Jackson

[57] ABSTRACT

Pipe coating apparatus is disclosed. In the preferred and illustrated embodiment, a laterally deployed conveyor belt rotating around a pair of rollers passes beneath the pipe to be coated. Coating material is supplied into a hopper above the belt. The hopper includes positioned slots for receiving reinforcing mesh therein and locates the reinforcing mesh in an extruded ribbon of coating material supported by the conveyor belt and applied to the pipe in helical turns. The application of multiple turns of reinforcing mesh plus shaping of the extruded ribbon enables a thicker layer of coating material to be applied to the pipe, and it is reinforced with multiple layers of reinforcing mesh wire.

18 Claims, 7 Drawing Figures

PIPE COATING APPARATUS

BACKGROUND OF THE DISCLOSURE

U.S. Pat. Nos. 4,006,049 and 4,058,428 are directed to pipe coating apparatus. This disclosure is an improvement in the structure of the reference pipe coating apparatus. As a practical matter, concrete which is applied to a pipe as weight material normally requires reinforcing mesh to enhance its strength. As a generalization, concrete is very weak in tension. In the handling of pipe with a concrete coating thereon, inevitably, certain parts of the coating material are loaded in tension. When tension is applied, the concrete will crack and break away from the pipe.

The reference patents disclose pipe coating apparatus with a single wrap. This disclosure is directed to a multiple wrap of reinforcing mesh. Multiple layers of reinforcing mesh wire provide enhanced strength and are able to prevent breaking or cracking of thicker layers of weight material. As an example, the referenced patents do quite well in placing weight material on a pipe up to a fairly significant thickness. Dependent on the thickness required, the handling to be encountered after curing, the size, length and flexure of the pipe and a number of other factors, it is sometimes desirable to incorporate an additional layer of reinforcing mesh wire in the coating material to prevent breaking.

This disclosure describes a pipe coating apparatus having a feature enabling multiple wraps of reinforcing mesh to be placed in the weight material.

It is not quite so easy to simply add layers of reinforcing mesh wire. As layers are added, a problem arises in that adjacent turns of the coating material applied in helical fashion around the pipe are crushed against prior turns. This folds the reinforcing mesh in an odd manner at the edges. So to speak, adjacent turns of the same strip of reinforcing wire mesh provide greater strength if they lap over and are almost contacted against one another. As adjacent turns are crushed into the prior turns of coating material, the lip or margin of the previous turn is crushed down, thereby preventing a single strip from defining an encircling cylinder of structural reinforcing wire mesh within the concrete.

This apparatus overcomes that difficulty. This apparatus places adjacent turns of the reinforcing mesh in the concrete in the general form of a cylinder so that strength is increased, and the holding ability is enhanced. If, for instance, two or more layers of reinforcing wire mesh are placed in the coating material, they are lapped over at their edges to define two or more generally concentric cylinders of structural reinforcement within the thicker coat of concrete material. This is achieved in part by an alternate form of shaping the ribbon of concrete material which is carried on the conveyor system toward the pipe.

With the foregoing features and advantages in mind, this apparatus is an improved pipe coating apparatus featuring an upstanding funnel-shaped hopper or bin which receives a continuous supply of coating material. It is positioned above a conveyor belt. One feature of this invention is the incorporation of multiple slots in the back side of the hopper. This enables multiple strips of reinforcing wire mesh to be fed into the extruded ribbon of coating material. They are positioned at relative heights above the conveyor belt and are offset from one another. Moreover, they pass through the hopper and emerge with a ribbon of coating material. The ribbon of coating material is shaped into steps so that the top face thereof is stepped from edge to edge. The position of the steps is related to the relative position of the strips of reinforcing wire mesh. The ribbon of coating material is crushed against the pipe in conjunction with the roller beneath the pipe which guides the conveyor belt, and the steps are matched against the coating material applied in the previous turn, thereby enabling the pipe to be coated to a much greater thickness with reinforcing mesh.

BRIEF DESCRIPTION OF THE DRAWINGS

So that the manner in which the above recited features, advantages and objects of the invention, as well as others which will become apparent, are attained and can be understood in detail, a more particular description of the invention briefly summarized above may be had by reference to the embodiments thereof illustrated in the appended drawings, which drawings form a part of this specification. It is to be noted, however, that the appended drawings illustrate only typical embodiments of the invention and are not to be considered limiting of its scope, for the invention may admit to other equally effective embodiments.

DETAILED DESCRIPTION OF THE PREFERRED EMBODIMENT

Figure 1:
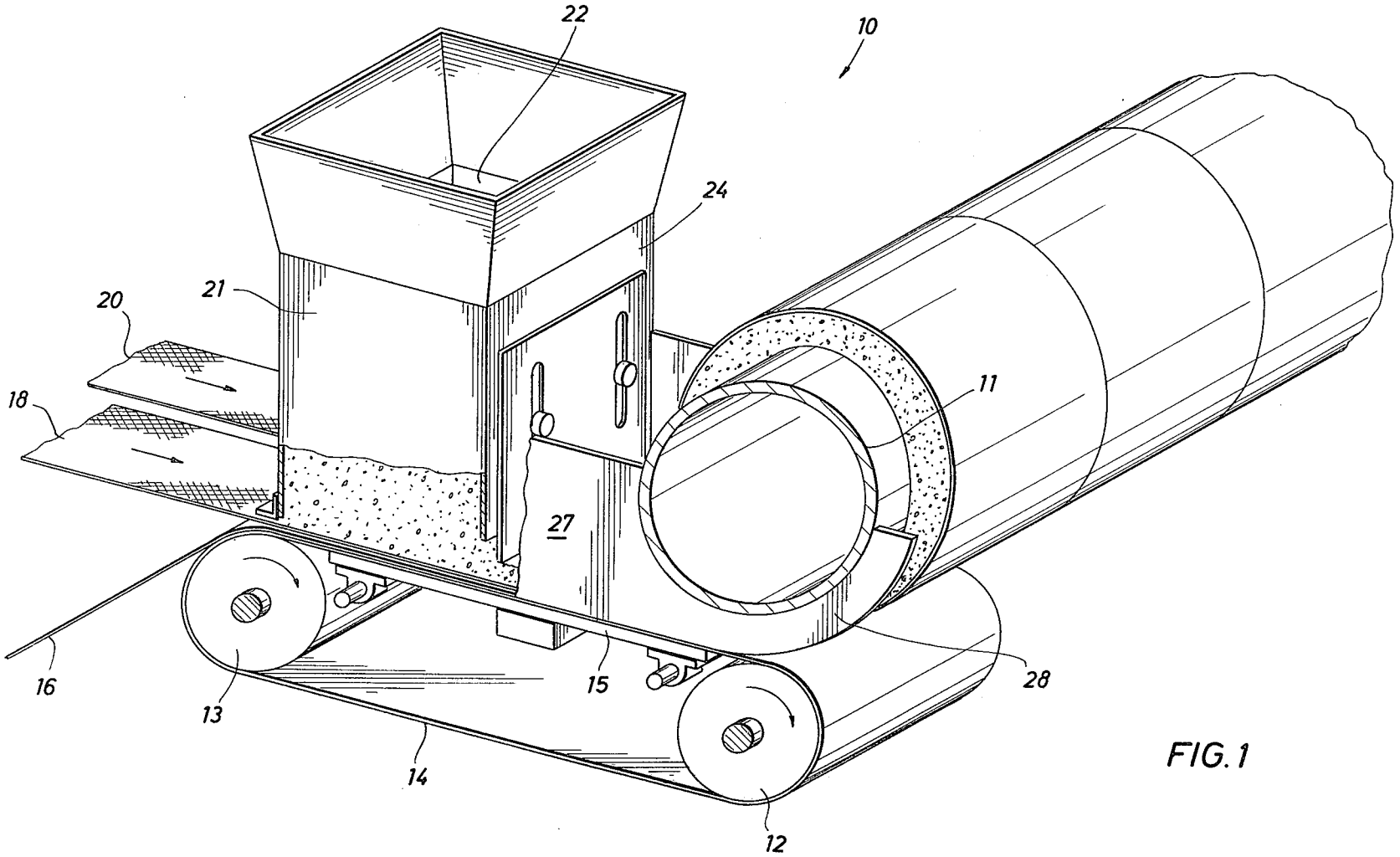
FIG. 1 is an elevated perspective view of the pipe coating apparatus of the present invention applying helical turns of coating material to a pipe.

Attention is first directed to FIG. 1 of the drawings where the numeral 10 identifies the pipe coating apparatus of this disclosure. A pipe 11 is coated with multiple turns of coating material. Briefly, the apparatus shown in FIG. 1 is similar in many regards to the structure disclosed in the referenced patents. It utilizes a first roller 12 which is positioned beneath the pipe 11. A second roller 13 is spaced to the side. The rollers 12 and 13 support a wide conveyor belt 4 which travels in an endless loop with the direction of movement indicated by the arrows in FIG. 1. The conveyor belt 14 travels over a support plate 15 which maintains the belt in a desired plane and supports the weight material on it. The conveyor belt slides over the plate 15.

The numeral 16 identifies outer wrap material which is supplied in a long strip from a spool to the side. It is placed on top of the conveyor belt and wrapped around the coated pipe. The numeral 18 identifies a lower strip of reinforcing wire mesh, while the numeral 20 identifies a similar strip of reinforcing wire mesh spaced higher than the first strip. The strips 18 and 20 are of identical stock and differ in that two spools are supplied, one for each strip, which are fed into the ribbon of coating material in a manner taught by this disclosure.

A funnel-shaped hopper is shown in FIG. 1 and comprises parallel sidewalls 21 and 22. A front wall 24 supports a movable gate as will be described. A back wall 25 (see FIG. 3) completes the rectangular funnel-topped bin or hopper.

Coating material is formed typically using water, cement, gravel, sand and other additives to define a coating material having a specified thickness, moisture content, drying time and strength.

As disclosed in the mentioned patents, the pipe is rotated and advanced simultaneously. Referring to FIG. 1, the portion of pipe which is shown is the coated portion. The uncoated portion is delivered on a transport mechanism and advances approximately parallel to the axis of the roller 12. It passes over the edge defining, upstanding, metal sidewall 27. This is an extension of the sidewall 21 on the hopper. It is positioned adjacent to the ribbon of concrete material extruded from the hopper. One edge of the ribbon of material is defined by the sidewall 27. Indeed, it extends about 180.0 degrees around the pipe 11 in the form of the curved and shaped extension 28. The sidewall 27 confines one edge of the ribbon of concrete material. If, for instance, the ribbon of material is 6.0 inches wide, one edge is defined by the sidewall 27, and the ribbon of material is deployed against it. The ribbon of material travels on the conveyor belt 14. It is bordered by the sidewall 27. When it is applied to the pipe 11, the extension 28 continues to border the ribbon of material as it is jammed between the sidewall 27 and the previous turn of coating material.

Figure 2:
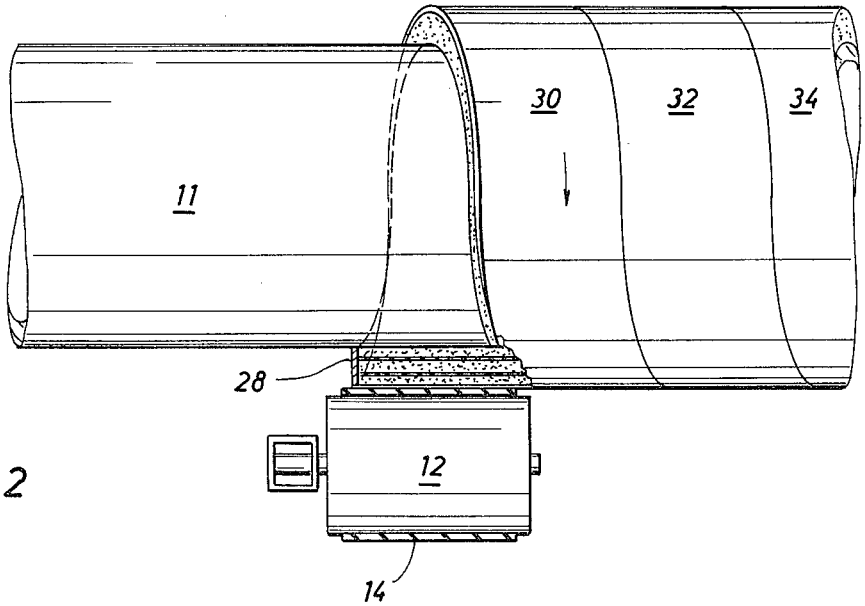
FIG. 2 is a side view showing the pipe above the roller with the coating material caught therebetween for applying coating material to the pipe under pressure.

The present invention works with multiple strips of reinforcing wire mesh. To this end, FIG. 2 shows in sectional view the pipe 11 positioned over the roller 12. The roller 12 cooperates with the conveyor belt 14 which passes around the roller. The extension 28 on the sidewall 27 is also shown in FIG. 2. FIG. 2 shows how a particular turn of coating material is applied between the sidewall 28 and the prior turns of the helical coating material.

FIG. 2 thus shows how rotation and advancement of the pipe relative to the conveyor system applies multiple turns. The previous turn is thus identified by the numeral 30. The turn placed on the pipe before that is identified by the numeral 32, while the numeral 34 identifies a prior turn. They are applied as one continuous ribbon, but the ribbon is wrapped in the form of a helix to thereby define a solid coating of specified thickness around the pipe. The thickness is determined in part by the thickness of coating material applied to the conveyor and is also determined in part by the spacing between the pipe 11 and the roller 12. As an example, the sidewall 28 might have a height of 4.0 inches. The ribbon of concrete coating material might be as much as 6.0 inches thick before compression. It may well be compressed to about 4.0 inches. Preferably, the ribbon of coating material is compressed to almost the same thickness as the sidewall extension 28. When compression occurs, bubbles are forced from the material, and compaction makes the pliant material into a more solid body. While it is still tacky with water, curing hardens the coating material to the finished diameter after application. The ribbon of material which is applied in FIG. 2 includes two ribbons of reinforcing material. Their deployment is better understood on viewing FIGS. 3 and 4.

Figure 3:
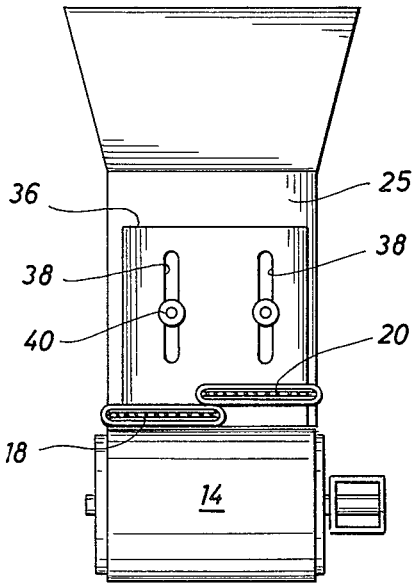
FIG. 3 is a back view of the supply hopper showing a pair of strips of reinforcing wire mesh passing through staggered and offset slots in the supply hopper.

Referring now to FIG. 3, it discloses the supply hopper and, in particular, the back wall of the hopper. The conveyor belt 14 is wrapped around the roller in this view and passes beneath the hopper. The hopper has a back gate 36 mounted for sliding movement. Movement is obtained by anchoring the back gate 36 to the wall 25 through the use of slots 38 which permit upward sliding movement beneath a set of lock bolts 40. The bolts 40 have heads and washers which are larger than the slots 38 to thereby anchor or clamp the gate 36. The gate 36 is positioned at a specified height. As it is raised or lowered, it changes the relative vertical position of the two strips of reinforcing wire mesh. It will be recalled that the lower strip is identified by the numeral 18, while the upper strip 20 is spaced above the lower strip. The strips 18 and 20 are offset vertically and are also offset horizontally. The vertical spacing between the two strips is in part dependent on specifications for the particular job. In some instances, they might be spaced 1.0 inch apart, while, in other instances, the spacing may be 2.0 or 3.0 inches apart. Whatever the spacing, they are set at the specified levels. This enables the equipment to function to position the two strips 18 and 20 at a desired level in the ribbon of material and at a desired spacing from one another. FIG. 3 shows the two strips offset laterally. They are offset laterally to enable both to be applied simultaneously without interfering with the other strip of reinforcing mesh. The extent of offset is again dependent on specifications and can be varied. Variation of the horizontal and vertical offset between the two ribbons 18 and 20 shown in FIG. 3 is accomplished by alteration of the plate 30. The plate 30 supports the two slots as shown in FIG. 3, and the plate is reconstructed to change the spacing. While this at first blush may seem unwieldy, it is more desirable to build the gate 36 to accommodate a specified dimensional arrangement. This yields a permanent arrangement. Ordinarily, once the specifications are made, several thousand feet of pipe will be coated, and the permanently constructed gate 36 can be used for the entire job. Reconstruction or modification of the gate 36 which supports the two slots shown in FIG. 3 is thus accomplished only between jobs and typically by refurbishing the gate 36. In the event the gate 36 is merely raised, the direction of travel of the conveyor 14 and the strips 18 and 20 prevents escape of granulate coating material through the slot left by the gate 36 above the conveyor belt 14.

Figure 4:
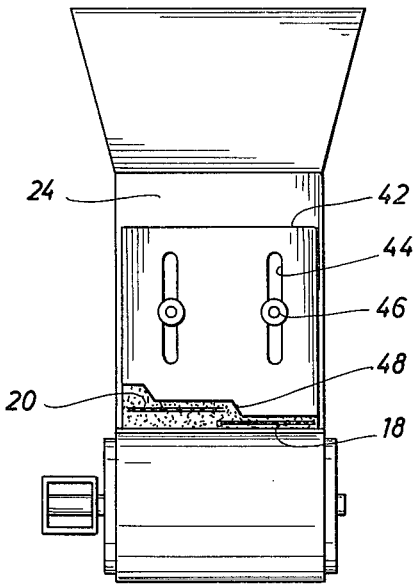
FIG. 4 is a view of the front side of the hopper shown in FIG. 3 including an adjustable gate which forms the ribbon of coating material on the conveyor system, the ribbon having a stepped top face.

In FIG. 4 of the drawings, a slidable gate 42 is shown mounted with lengthwise slots 44 which are, in turn, clamped by a set of bolts 46 so that the gate can be raised or lowered. The bottom edge is profiled at 48 with steps. Several steps are shown. In FIG. 4, the profiled bottom edge 48 determines the thickness and shape of the extruded ribbon. FIG. 4 is better understood by recalling that the ribbon of material is proceeding out of the plane of the view carried on the conveyor belt. The conveyor thus bottom supports the ribbon of extruded material. The lower strip 18 is shown adjacent to the bottom face of the extruded ribbon. It will be recalled that the bottom face of the extruded ribbon is the outer face when applied to the pipe. In other words, the outer face of the coating material is the face immediately adjacent to the conveyor.

The profiled edge 48 includes steps. To this end, a step is formed at the edge of each ribbon of wire mesh. If, for instance, the apparatus uses four ribbons of wire mesh, the four are laterally and vertically offset, and each offset is defined by a step. The function of the steps will be more readily understood on explanation of the remainder of the apparatus.

Figure 5:
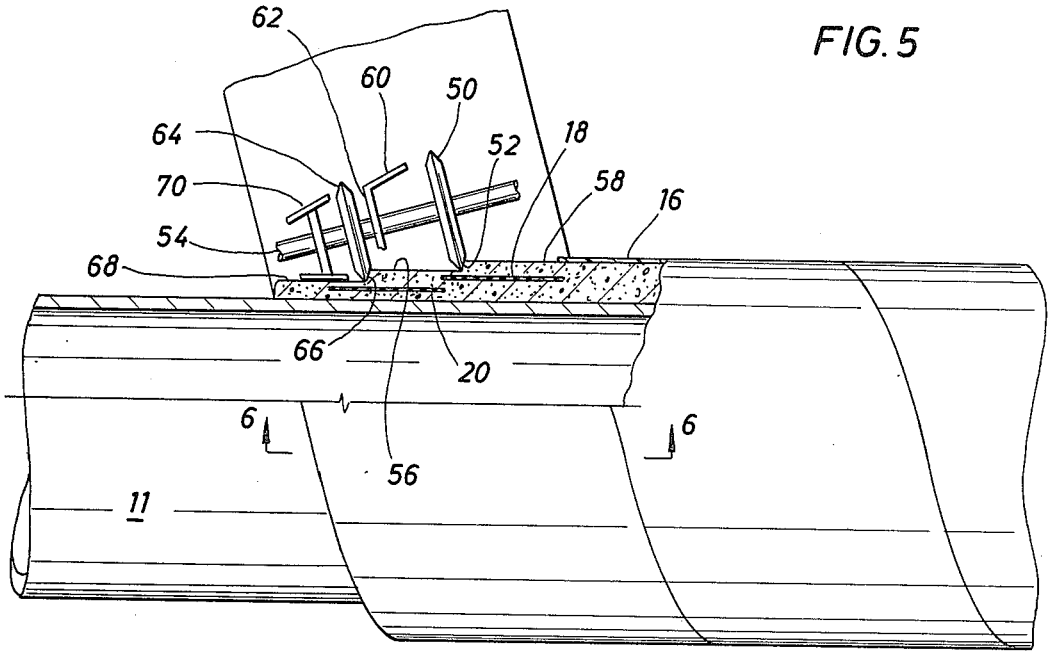
FIG. 5 is a plan view showing a cutter mechanism which forms steps in the previously applied coating material.

Attention is next directed to FIG. 5 of the drawings where the apparatus is shown after the device 10 has applied consecutive helical turns to the pipe 11. The numeral 16 identifies the outer wrap material which is applied offset so that the turn last applied is exposed on wrapping around the pipe. It is exposed for less than one full turn. If the ribbon of coating material is 8.0 inches wide, the outer wrap might be offset by as much as 6.0 or 7.0 inches. This leaves a substantial portion of the outer face of the last turn (defined as 360.0 degrees or less) applied to the pipe exposed at its outer face. As previously mentioned, the strip 18 is at the lower position in FIG. 3. When applied, it is at the upper position shown in FIG. 5. It is closer to the outer face and has a finite width. Immediately adjacent to the mesh 18, a cutter 50 cuts into the applied material to cut and define an exposed external shoulder 52. The shoulder 52 is just above and slightly inboard of the edge of the strip 18. The cutter 50 is a free rotating disk having a sharp edge and is mounted on a shaft 54 for rotation with the shaft. It rotates in a free manner, able to cut the shoulder 52. The shoulder 52 is immediately adjacent to an exposed face 56. The face 56 is approximately concentric to the exposed outer face 58. The face 56, however, has reduced thickness of the ribbon of material. It will be recalled that the ribbon has a single planar bottom face as shown in FIG. 4. A portion is cut away to define the face 56. The face 56 is in part cut by the disk or cutter wheel 50. The face 56 is cut by a rotatable knife edge 60 which is positioned at an angle so that it strikes away surplus concrete to define the face 56. The knife edge 60 is duplicated at four or five locations around a disk 62 which rotates with the shaft 54. The shaft 54 rotates the relatively thin and narrow knife edge 60 so that it cuts away surplus material. The angle of the knife edge 60 (in actuality, the common angle of the cone of rotation of the several knife edges which together form the cone) conforms the face 56 to the thickness desired. Surplus material which is cut away scatters and falls downwardly onto the ribbon. As it falls, it is picked up for subsequent reapplication to the pipe. The shaft 54 supports a second cutting disk 64 which cuts a second shoulder 66. The shoulder 66 is similar to the shoulder 52 and is located at a specified or registered distance from the edge of the second reinforcing strip 20. The two reinforcing strips 18 and 20 overlap slightly. Shoulders are cut so that the two reinforcing strips can be jammed together and thereby overlapped on applying the strip of concrete material to prior turns positioned on the pipe. It will be understood that the shoulders 52 and 66 are left for a portion of a revolution so that the next wrap or turn of the weight material will abut against the shoulders 52 and 66.

The face 68 is cut by several knives 70 which rotate around the shaft 54. As described to this point, the ribbon which is applied to the pipe is not a simple rectangle; it is shaped in the following manner. Each wrap of ribbon material is shaped in the manner shown in FIG. 6. The shoulders 52 and 66 are exposed to the next wrap of material. The next helical turn momentarily spaced from the prior helical turn in FIG. 6 includes mating shoulders and faces. The shoulder 52 thus conforms to the shoulder 72 formed on the ribbon by the gate 42. Returning again to FIG. 4, it will be observed that the profiled edge 48 forms the top of the ribbon in shoulders and steps that match the shoulders and steps out into the exterior of the prior wrap of material. The shoulders 52 and 72, therefore, abut and match one another. The numeral 56 identifies the exposed face adjacent to the shoulder 52. A matching face 76 is formed on the top face of weight material. The shoulder 66 is similar to the shoulder 52, terminating the face 56 and lying approximately parallel to the shoulder 52. The shoulder 78 matches it so that the next turn of material again conforms. Without regard to the particular number of shoulders and faces found in the profile of the last applied helical turn, the next applied helical turn matches, and the two helical turns are forced together on application. The direction of movement is fairly well indicated by the direction of the arrow 80. This direction of movement is determined by the lead angle of the pipe relative to the conveyor belt. When viewed in plan view, the pipe 11 has a major axis which is approximately perpendicular to the direction of travel of the conveyor 14. The angle is not quite perpendicular; a lead angle is incorporated so that one full revolution of the pipe advances the pipe by the width of the ribbon. In other words, if the ribbon of material which is applied to the pipe in one full revolution is 6.0 inches, the pipe must advance 6.0 inches for each revolution, and the arrow 80 is offset slightly from perpendicular application of the helical turn by an angle related to the lead angle. Depositing the next turn of material by applying it with a force in the angular direction identified by the arrow forces the shoulders 52 and 72 together.

Figure 6:
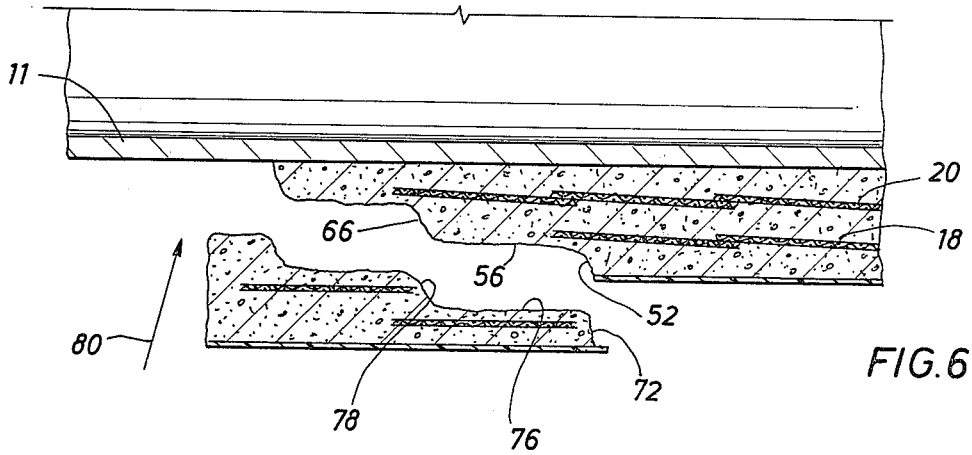
FIG. 6 is an enlarged, detailed view in section showing how a ribbon of coating material is applied to a pipe with multiple steps in both faces where the steps match to enable multiple layers of reinforcing wire mesh to be applied.

When one helical turn is applied against a prior helical turn and there is overlap between the two, the reinforcing wire mesh is applied with the edges overlapped. FIG. 6 discloses overlapping of each of the two layers. Each turn is overlapped inasmuch as the reinforcing wire mesh has a width equal to or greater than the lead of each turn of the apparatus, thereby enabling overlapping to this extent.

Overlapping enhances strength of the coated material. Overlapping enables the weight material, when cured and hardened, to rely on a cylindrical sleeve formed of multiple turns of the reinforcing material, the cylindrical sleeve being reinforced by the overlap which is accomplished in the structure. The apparatus includes a measure of overlap which enables the resilient material to be forced somewhat out of the way so that overlapping of the reinforcing wire mesh is accomplished.

Figure 7:
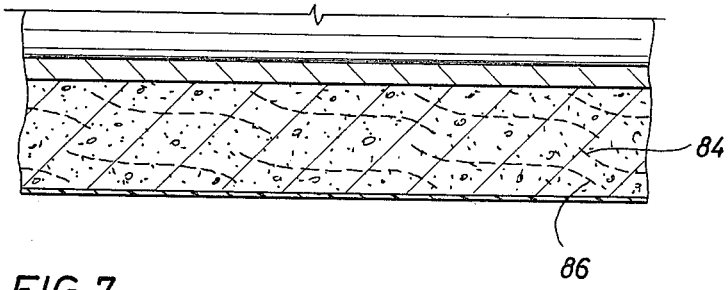
FIG. 7 shows the coating after the ribbon has been applied to the previous turn of coating material as shown in FIG. 6, FIG. 7 exaggerating marginal bending of the reinforcing wire mesh on application.

The preferred embodiment of this apparatus applies the ribbon wherein some part of the resilient material is crushed into the prior turn. FIG. 6 discloses an approximate profile to thereby depict how each wrap of material comes into contact with a prior turn. As each turn is applied, it is jammed against the prior turn. The profiling of the ribbon at the time of joinder to the prior turn enables the two turns to come together without piling particulate coating material in a manner to prevent overlapping of the reinforcing wire mesh. The desired spacing of the reinforcing wire mesh is shown in FIG. 6. By contrast, FIG. 7 discloses distortion of the reinforcing wire mesh where each turn is forced against the prior turn and thereby folds the reinforcing wire mesh down at the edge and away from a properly lapped joint. Thus, the edge 84 is folded down, while the edge 86 of the same strip of reinforcing wire mesh is folded up, and the two do not overlap. The structure of FIG. 7 is to be avoided because it is a weaker structure. The reinforcing wire mesh has been bent and prevents the edges from lapping over and coming into a common cylindrical concentric relationship in the manner shown in FIG. 6.

The method of the present invention contemplates shaping each turn on both major faces. The major faces are the exposed top surface area and the bottom surface area which originally is in contact with the conveyor belt. The bottom face cannot be shaped while on the conveyor because it must be supported by the planar surface of the conveyor belt 14 until after application. The several turns are applied in like manner. The ribbon which travels along the conveyor is shaped on its top face at the time of application. It will be recalled that the top face of the ribbon while on the conveyor is the face of the material which is jammed against the pipe 11 at the time of application. This is particularly understood on viewing FIG. 2 of the drawings where the weight of the coated pipe forces the pipe against the conveyor to adhere the weight material to the pipe. The bottom face on the conveyor is the exposed external face after application. It is exposed and on the outside of the pipe, the pipe rotating in a continuous fashion. This face of material is exposed for cutting and carving. It is cut and carved to form the shoulders and steps in the manner shown in FIG. 5.

The shaft 54 of FIG. 5 can optionally be rotated at a relatively high rate of speed. The quantity of material which is cut from the applied helical turn in FIG. 5 falls downwardly and back onto the conveyor belt. It tends to scatter. As it falls, it slightly thickens the ribbon of material extruded from the hopper shown in FIG. 4. While this may obscure the sharp edges at the shoulders as formed in FIG. 4, it, nevertheless, does not deter application of the ribbon of extruded material carried on the conveyor. It will be recalled that the conveyor carries material which has been somewhat compressed by the weight of surplus slurry in the hopper. This is somewhat loose, and tight packing is achieved only at the time that the conveyor passes beneath the pipe, and the weight of the pipe compressively applies the last turn of material to the coating.

The present invention is enhanced by including means for shaping both major surface areas on the ribbon of material. One major surface is profiled before application, while the other major surface is profiled after application. The relative consistency and hardness of the weight material is somewhat different after application, this being a result of the compressive loading which applies the material to the pipe.

The compressive loading is depicted in FIG. 2 of the drawings. It is particularly noted that the compressively loaded coating material is jammed against the pipe, and, very importantly, it is simultaneously jammed against the shoulder of the last turn. To the extent that overlapping occurs, an extra thickness of weight material is made available. It is squeezed laterally, the lateral squeeze assuring that voids in the ribbon of weight material are fully filled. Any surplus material thus moves laterally and assists in packing each applied turn evenly, even to the adjacent sidewall 28.

When each turn is applied, the outer wrap is offset laterally to leave a portion of the last turn exposed. For example, should the first step 52 be cut at the centerline of the last applied turn, the outer wrap is preferably offset laterally so that the cutter 50 is working parallel to the outer wrap material, but does not cut the outer wrap material 16. This is a relative matter and is accommodated in ordinary operations of the device. Should the shoulder 52 be located elsewhere, the outer wrap material 16 is aligned as required, shifting laterally relative to the ribbon so that the amount of exposed surface after application is either increased or decreased.

In the preferred embodiment, two strips of reinforcing wire mesh are incorporated, and three shoulders are shown in FIG. 6. One shoulder can be formed by the sideboard 28. The other two are formed by cutters. These numbers can be modified as, for instance, by incorporating three strips of reinforcing wire mesh and the formation of four shoulders. This process can be repeated again for an alternate number of layers of reinforcing mesh.

It is important to utilize a slurry which is formed of ingredients having an average particle diameter sufficiently small that it can pass through the interstices of the reinforcing wire mesh. It is desirable to pull the reinforcing wire mesh slightly taut during and after application. It is undesirable to punch the reinforcing wire mesh by distorting it where it must pass over a large rock, being relatively large compared to the dimensions of the coating material and the holes in the mesh. This depends on the grading of the gravel utilized in manufacture of the coating material.

While the foregoing is directed to the preferred embodiment of the present invention, other and further embodiments of the invention may be devised without departing from the basic concept thereof, and the scope thereof is determined by the claims which follow.

I claim:

1. Apparatus for placing weight material on a pipe which is axially advanced along its major axis and is rotated as it advances so that the pipe moves along a helical path, the apparatus comprising:

(a) a conveyor having
  (1) an endless loop belt having an exposed top surface;
  (2) a first roller within said looped belt;
  (3) a second roller within said looped belt;
  (4) said rollers stretching said looped belt taut to define an exposed top surface;
  (5) motive means for moving said belt in endless travel around said rollers such that the top surface thereof advances in a given direction;

(b) means positioning a helically rotating pipe above said belt located to enable the top surface thereof to advance toward the pipe approaching from a lateral direction below the pipe; and (c) means for depositing a supply of tacky weight material on the top surface of said looped belt in the form of a shaped ribbon; and (d) cutting means for cutting the ribbon along an edge of the ribbon face after the ribbon is adhered to the pipe.

2. The apparatus of claim 1 including means for shaping the ribbon of weight material into an elongate ribbon having an exposed step formed therein defining first and second lengthwise faces in the ribbon.

3. The apparatus of claim 1 including means for embedding first and second parallel strips of reinforcing material in the ribbon of weight material, said means placing the strips of reinforcing material at specified locations in the ribbon of weight material.

4. The apparatus of claim 3 including means for shaping the ribbon of weight material into an elongate ribbon having a step formed therein defining first and second lengthwise faces in the ribbon prior to application.

5. The apparatus of claim 4 wherein said shaping means comprises profiled edge means above said belt having a specified shape and spacing thereabove to scrape weight material carried on said belt to conform the ribbon with said profiled edge means.

6. The apparatus of claim 4 wherein said shaping means comprises first means for forming the weight material into a ribbon and a second means located to cut away a portion of the ribbon formed by said first means.

7. The apparatus of claim 6 wherein said first means comprises profiled edge means above said belt having a specified shape and spacing thereabove to scrape weight material carried on said belt to conform the ribbon with said profiled means.

8. The apparatus of claim 6 wherein said second means comprises a rotatable disk having a cutting edge therearound and mounted to cut into the ribbon.

9. The apparatus of claim 1 including:

(a) an open-topped weight material receiving chamber means defined by a wall above said belt wherein said belt moves linearly thereunder, said chamber means defining a gap above said belt to enable a ribbon of weight material to travel along said belt; and (b) first and second slots formed in the wall of said chamber means, said slots aligned with said belt to direct elongate strips of reinforcing material in the ribbon of weight material from the exterior of said chamber means into said chamber means and extending parallel to said belt.

10. The apparatus of claim 9 wherein said chamber means is defined by four upstanding walls, one of said walls having said first and second slots therein and one of said walls having a bottom edge located, profiled means above said belt for scraping weight material to define a ribbon on said belt wherein said belt passes beneath both of said walls.

11. The apparatus of claim 1 wherein said cutting means comprises a rotating cutter positioned to cut the applied helical turns of the ribbon on the pipe, said cutting means further being positioned to cut the applied helical turn within 360.0 degrees of rotation of the pipe after application of the ribbon to the pipe.

12. The apparatus of claim 1 wherein:

(a) said belt passes beneath the pipe to adhere the ribbon to the pipe;

(b) said cutting means is positioned angularly and axially of the pipe to contact the applied ribbon on rotation of the pipe less than 360.0 degrees after application.

13. The apparatus of claim 1 wherein:

(a) said belt forms a planar bottom face on the ribbon applied to the pipe which bottom face is outwardly exposed after application; and (b) said cutting means includes means for forming a lengthwise shoulder along the ribbon by cutting into the outwardly exposed face.

14. The apparatus of claim 1 wherein:

(a) said belt forms a planar bottom face on the ribbon applied to the pipe which bottom face is outwardly exposed after application; and (b) said cutting means includes means for forming a lengthwise second exposed face in the ribbon.

15. In a method of coating pipe with an adhesive weight material on the exterior of the pipe wherein the weight material is applied in repetitive adjacent helical turns encasing the pipe, the improvement comprising the steps of:

(a) shaping the ribbon into an elongate ribbon having first and second elongate strips of reinforcing wire mesh materials therein wherein the first and second strips are positioned apart from one another in the ribbon and the ribbon is moved generally horizontally toward the pipe to wrap around the pipe;

(b) shaping the ribbon into a uniform cross-section along the length of the ribbon wherein the ribbon has a lengthwise shoulder positioned relative to the first and second strips and between the lengthwise sides of the ribbon;

(c) wherein the step of shaping the lengthwise shoulder occurs prior to positioning the ribbon against the pipe;

(d) shaping the ribbon of weight material after application to the pipe to form an exposed lengthwise shoulder; and (e) placing a helical turn of the ribbon against the previously applied turn with the lengthwise shoulder on the ribbon facing and contacting the lengthwise shoulder of the previously applied turn on the pipe.

16. The method of claim 15 further including the step of shaping the facing lengthwise shoulders prior to contact into stepped shoulders.

17. The method of claim 16 including the step of offsetting one of the elongate strips laterally from one another by an amount related to the width of the steps on the stepped shoulders.

18. The method of claim 17 further including the stepped and overlapping faces on both of said shoulders, there being a step for each of said first and second strips of reinforcing wire mesh to enable each of said strips to individually overlap against itself.

* * * * *